United States Patent [19]

Hahn et al.

[11] 4,308,933

[45] Jan. 5, 1982

[54] OVERHEAD SOUND ATTENUATING COVER FOR ROADWAYS AND RAILWAYS

[75] Inventors: Volker Hahn, Leinfelden-Echterdingen; Horst Widmann, Stuttgart, both of Fed. Rep. of Germany

[73] Assignee: Ed. Züblin Aktiengesellschaft, Stuttgart, Fed. Rep. of Germany

[21] Appl. No.: 86,256

[22] Filed: Oct. 18, 1979

[30] Foreign Application Priority Data

Oct. 18, 1978 [DE] Fed. Rep. of Germany ..... 2845267

[51] Int. Cl.[3] ..... G10K 11/00

[52] U.S. Cl. ..... 181/210

[58] Field of Search ..... 181/141, 210, 198, 200, 181/202, 205; 52/144, 145; 104/138 R

[56] References Cited

U.S. PATENT DOCUMENTS

| | | | |
|---|---|---|---|
| 3,837,285 | 9/1974 | Goering | 104/138 R X |
| 4,015,682 | 4/1977 | Keller | 181/210 |
| 4,050,538 | 9/1977 | Desenfant | 181/210 |

*Primary Examiner*—L. T. Hix
*Assistant Examiner*—Thomas H. Tarcza
*Attorney, Agent, or Firm*—Becker & Becker, Inc.

[57] ABSTRACT

An overhead sound attenuating cover arrangement comprising a support structure and cover elements operatively arranged on the support structure. The cover includes at least in part between individual cover elements spaces, whereby cover elements in the vicinity of such spaces are arranged in an overlapping manner in such a way that sound emitted at any given point on the roadway is deflected from a straight path when passing through said cover arrangement.

11 Claims, 5 Drawing Figures

OVERHEAD SOUND ATTENUATING COVER FOR ROADWAYS AND RAILWAYS

The present invention relates to an overhead sound attenuating cover, especially for regions or ranges of roadways and railways, including a support structure and cover elements for right-of-way or land-traffic routes.

The cover in accordance with the present invention is primarily intended for roadways subjected to heavy traffic, in the vicinity of houses and recreational areas, for protecting residents or users of the recreational areas against noise. The presently used constructional measures for noise protection include noise protecting walls and embankments or dams arranged along the roadway. However, it has been shown in practice that only a limited result of noise protection can be achieved with noise protective walls which are relatively high. This is an actuality in practice because, despite the provision of such walls, due to the deflection of the sound waves, noise can reach the areas behind the protective walls.

A further measure much improved but up to now rarely utilized constructive measure to reduce noise levels involves the arrangement of roadways beneath the ground level in tunnels.

However, the utilization of conventional tunnels for noise protection purposes has faltered mostly due to the high costs of such tunnels. The costs of the installation and the maintenance costs for ventilation and lighting for such tunnels cause a substantial portion of the overall costs.

It is an object of the present invention to provide a cover, especially for roadways and railways, which provides for a substantially improved noise protection in comparison with the known noise protective walls, which, however, are permeable in such a way that forced ventilation and artificial lighting need not be utilized.

This object and other objects and advantages of the invention will appear more clearly from the following specification in connection with the accompanying drawings, in which.

Figure 1:
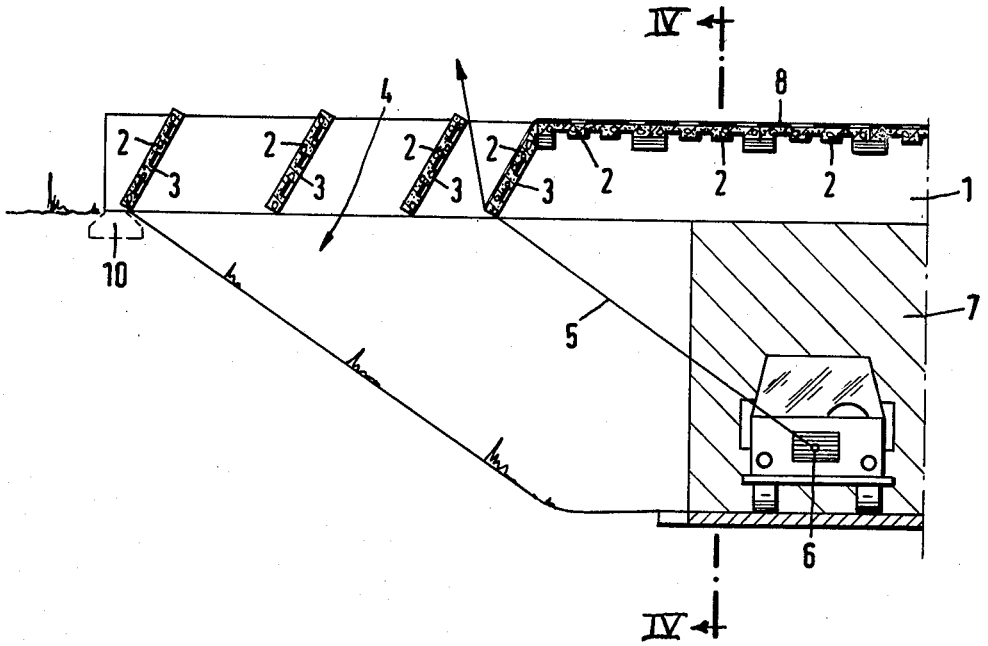
FIG. 1 is a diagrammatic sectional view indicating a transverse cross section of a road arranged in a cut or excavation.

The cover in accordance with the present invention as shown in the drawings is characterized primarily therein that the cover includes spaces 4 between at least some of the individual cover elements 2 provided in the region of these spaces, whereby the cover elements 2 are arranged relative to one another in such a way that no sound waves, also designated or characterized as rays, emitted from any given point on the roadway are emitted from the cover in undeflected manner.

The arrangement of spaces 4 between the individual cover elements 2 ensures a continuous air exchange between the interior and the exterior and permits light to shine from above into the covered roadway space. With a corresponding dimensioning and arrangement of the spaces 4, there is made possible that forced ventilation and/or artificial light need not be utilized.

The arrangement of cover elements 2 in the region of the spaces 4 provides that sound does not leave the cover in a straight line, i.e. all sound receivers are protected outside of the covers by the cover elements 2. By a corresponding selection of overlap and/or the umbrella value or protective value and with provision of sound absorbing layers, a predetermined degree of sound protection of the cover can be achieved.

In accordance with a preferred embodiment of the invention, the cover extends above a roadway as well as a predetermined distance on at least one side thereof. The cover elements are arranged generally above the roadway without forming spaces whereas the cover elements arranged generally to the sides of the roadway are arranged at least in part to form spaces 4. The cover elements can be arranged to be spaced from and parallel to one another and at an angle or horizontally to a roadway or right-of-way region. They can be in abutting relation above the roadway to protect the roadway against precipitation and in winter against ice formation on the roadway.

Preferred materials for the cover elements 2 include steel-reinforced concrete and prestressed concrete which are economical materials of construction for such construction elements or modules.

In accordance with a preferred embodiment, the cover elements are prefabricated elements which, produced in large quantities, provide for a reduction of the capital investment required.

For reasons of construction techniques, the cross section of a ribbed plate is preferred for the cover elements. These are preferred also because of acoustical reasons since, upon application of a sound absorbing material layer, an echo chamber is produced which beneficially affects the absorption qualities of a covering element. It is preferred, in addition, to arrange protective coverings on the cover elements for protecting these elements and the roadway against the elements.

The provision of light emitting means in the cover elements leads to an improvement of the light conditions beneath the cover.

In accordance with the present invention it is also preferred to provide the cover elements with bright surfaces and/or reflective surfaces. This will achieve better light conditions beneath the cover since with the reversal of the incoming light less absorption losses occur than would be the case with dark, non-reflecting surfaces.

Figure 4:
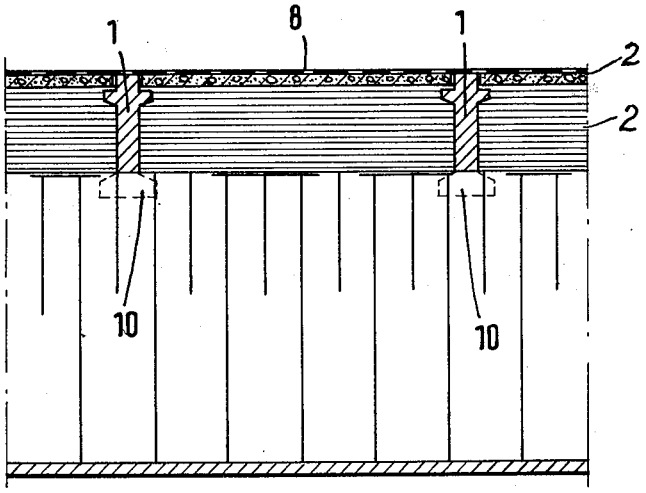
FIG. 4 is a cross section along line IV—IV in FIG. 1.

Referring now particularly to the drawing illustrations, FIG. 1 shows one half of a roadbed or right-of-way region arranged in a cut or excavation, i.e. a passage cut into terrain as a roadway. A cover including a support structure 1 and cover elements 2 covers the roadway from above. The support structure comprises transverse carriers arranged at predetermined distances and supported on base members 10 in the vicinity of the embankments. The cover elements 2, as is indicated in FIG. 4, are stressed in the longitudinal direction and are supported on the transverse carriers.

In the region above the roadbed 7, the cover elements 2 are arranged to be directly adjacent to one another. In this region the cover elements 2 are covered at least in part with a protective covering 8. In this manner the roadway is protected against precipitation. In the lateral region to one side of or, i.e. in the region outside of the roadway itself traversed by a vehicle 6, the cover elements 2 are arranged like louvers, so that light can enter and a continuous exchange of air can occur. The cover elements 2 are arranged when viewed from the roadway in such a way that any given beam or ray 5, produced by a vehicle 6, does not leave in a straight line through the cover but rather such a beam or ray 5 leaves only after a defraction or deflection. The deflection of the sound wave causes a reduction of the sound or noise level emitted from the right-of-way region.

In order to avoid reflection of sound on the cover elements 2, these elements can be covered with sound absorbing material, generally designated by the numeral 3. Cover elements 2 arranged generally to the sides of the roadway at least in part form intermediate space 4 relatively therewith.

Figure 2:
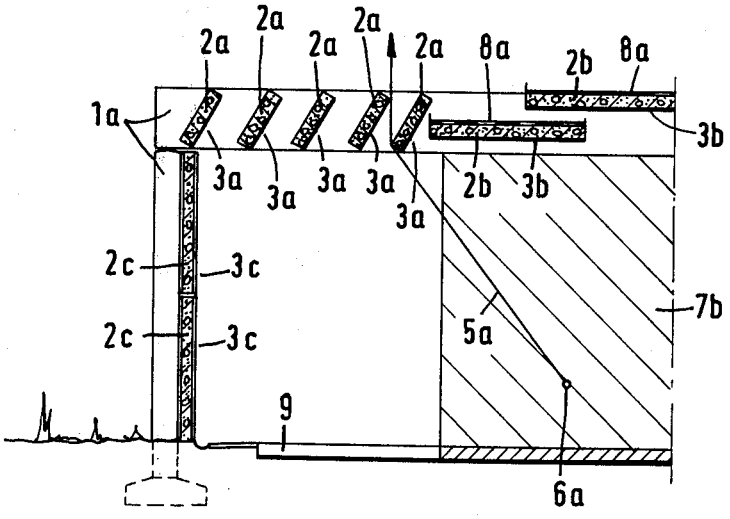
FIG. 2 is a sectional view similar to FIG. 1 showing the cover for a level roadway.

FIG. 2 shows a cover arrangement for a level road or right-of-way region in cross section. The support structure 1*a* includes support members and transverse carriers arranged in the longitudinal direction at predetermined spacings or locations on both sides of the road. The transverse carriers are supported on the vertical support members. The lateral cover elements 2*c* are secured on the support members and covered with an absorbing material 3*c*.

The upper cover elements 2*a* and 2*b* extend from transverse carrier to transverse carrier. In the lateral region, i.e. above the emergency lane or a similar space, the cover elements 2*a* are arranged for purposes of ventilation and illumination like louvers. In the region 7*b* above the road, the horizontal cover elements 2*b* are arranged having glued protective coverings 8*a* thereon. The cover elements 2*b* overlap one another so that air exchange can occur, but no precipitation reaches the road, it being understood, of course, that drain means have to be arranged, not shown, to remove liquid from the upper surfaces of the cover elements. All cover elements are provided with absorbing material layers. Also, in this example, the cover elements 2*a*, 2*b*, and 2*c* are aligned so that any sound ray 5*a*, produced by a source 6*a* in the region 7*b*, is deflected prior to leaving the cover.

Figure 3:
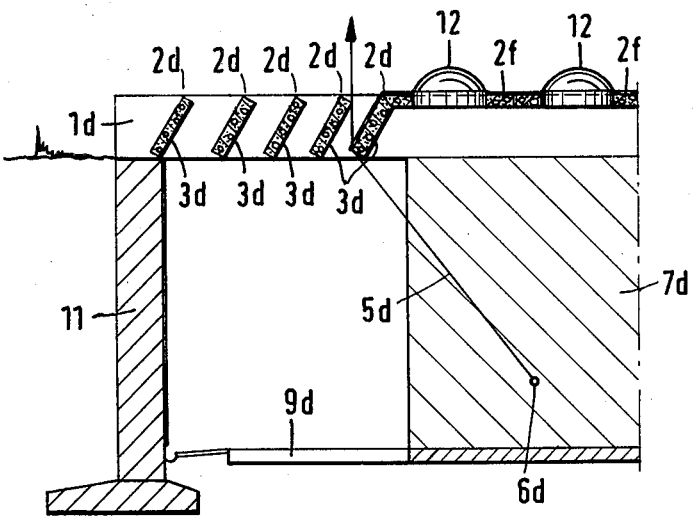
FIG. 3 is a sectional view similar to FIG. 2 of a roadway located between support walls.

FIG. 3 indicates a road which is arranged between supporting walls 11.

The support structure 1*d* includes transverse carriers which are resting or supported on the supporting walls 11. As was the case with the embodiment shown in FIG. 2, the cover elements 2*d* in the lateral region above the emergency lane 9*d* are covered with a sound absorbing material and are arranged, for purposes of ventilation and illumination, like louvers, whereby a sound beam or ray 5*d*, emitted from a source 6*d* in the region 7*d*, leaves the cover only after having been deflected. The cover elements 2*f* include, in the region above the road, light emitting means, such as light domes 12, to improve the light conditions of the road.

FIG. 4 shows a longitudinal cross section along line IV—IV of the embodiment in accordance with FIG. 1, particularly indicating pretensioning of the cover elements 2.

In essence, the cover elements 2 define a first cover portion over the roadway or railway and a second cover portion over a lateral area adjacent to the roadway or railway. The second cover portion includes a plurality of sound baffles 3 which are spaced with respect to one another and extend parallel to the longitudinal extent of the roadway or railway. Moreover, the sound baffles are at an acute angle with respect to the roadway or railway.

Figure 5:
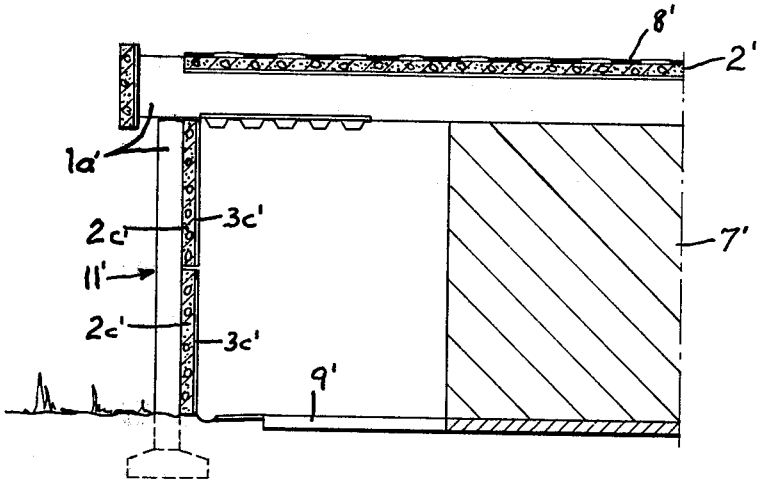
FIG. 5 is a cross section similar to FIG. 3 of another embodiment of a cover in accordance with the present invention.

FIG. 5 shows a further embodiment of the present invention in which use is made of a substantially continuous horizontal cover element 2' extending generally parallel to the road; reference numerals similar to those of FIGS. 1, 2, and 3 are provided with primes being added thereto in FIG. 5.

The present invention is, of course, in no way restricted to the specific disclosure of the specification and drawings, but also encompasses any modifications within the scope of the appended claims.

What we claim is:

1. A sound attenuating cover for use over a roadway or railway includes a lateral area which extends longitudinally along the side of the roadway, the cover including:

a first cover portion which extends over and completely covers the roadway or railway, and a second cover portion which extends in the horizontal direction and covers the lateral area only, the second portion including a plurality of sound baffles in the form of plates which plates extend substantially parallel with respect to the longitudinal extent of the roadway or railway, said plates being fixed and supported in spaced relation with respect to one another and each plate being oriented at substantially the same acute angle with respect to the roadway or railway, said plates also being intersected by a single horizontal plane; whereby the plates are parallel to one another to baffle sound emitted by vehicles travelling the roadway or railway while admitting light adjacent to the railway or roadway.

2. A cover in combination according to claim 1, wherein said cover portions are at least in part made of a sound absorbing material.

3. A cover in combination according to claim 1, wherein said cover portions are at least in part covered with an effective quantity of a sound absorbing material.

4. A cover in combination according to claim 1, wherein said cover portions are made of steel-reinforced concrete.

5. A cover in combination according to claim 1, wherein said cover portions are made of prestressed concrete.

6. A cover in combination according to claim 1, wherein said cover portions are prefabricated elements.

7. A cover in combination according to claim 1, wherein said cover portions have a cross section of a ribbed plate in the direction perpendicular to the load direction.

8. A cover in combination according to claim 1, wherein said cover portions are covered at least in part with a protective covering.

9. A cover in combination according to claim 1, wherein one of said cover portions includes light emitting means.

10. A cover in combination according to claim 1, wherein said cover portions have bright surfaces.

11. A cover in combination according to claim 1, wherein said cover portions have reflecting surfaces.

* * * * *